United States Patent [19]

Roush et al.

[11] Patent Number: 4,485,743

[45] Date of Patent: Dec. 4, 1984

[54] HIGH EFFICIENCY SEMI-ARTICULATED RAILWAY POWER TRUCK

[75] Inventors: Roy W. Roush, Downers Grove; Mostafa Rassaian, Chicago; Karl R. Smith, Downers Grove, all of Ill.

[73] Assignee: General Motors Corporation, Detroit, Mich.

[21] Appl. No.: 427,641

[22] Filed: Sep. 29, 1982

[51] Int. Cl.[3] ..... B61F 3/06; B61F 5/48

[52] U.S. Cl. ..... 105/176; 105/168; 105/175 R; 105/183; 384/193

[58] Field of Search ..... 105/165, 167, 168, 172–176, 105/182 R, 183; 384/192, 193

[56] References Cited

U.S. PATENT DOCUMENTS

| | | | |
|---|---|---|---|
| 1,129,930 | 3/1915 | Westlake | 105/174 |
| 1,241,105 | 9/1917 | Frindt | 105/183 |
| 1,276,636 | 8/1918 | Frede | 105/183 |
| 2,107,841 | 2/1938 | Seider | 105/175 R |
| 3,348,500 | 10/1967 | Akitt | 105/183 |
| 3,721,482 | 3/1973 | Tack et al. | 384/192 |
| 3,828,692 | 8/1974 | Kreissig | 105/165 |
| 3,862,606 | 1/1975 | Scales | 105/167 |
| 4,170,179 | 10/1979 | Vogel | 105/168 |
| 4,353,309 | 10/1982 | Pollard et al. | 105/182 R X |

FOREIGN PATENT DOCUMENTS

| | | | |
|---|---|---|---|
| 107213 | 9/1927 | Austria | 384/192 |
| 872350 | 10/1981 | U.S.S.R. | 105/182 R |

*Primary Examiner*—Randolph Reese

*Attorney, Agent, or Firm*—Robert J. Outland

[57] ABSTRACT

A semi-articulated railway power truck has in preferred embodiment a pair of dual axle sub-trucks semi-articulated for creep force balancing turning control while retaining freedom of rocking and relative longitudinal motion. An equalized centered bolster suspension and low traction rod linkage maintain high equalization of loads and tractive forces at the wheels to provide overall high adhesion and curving efficiency.

7 Claims, 8 Drawing Figures

HIGH EFFICIENCY SEMI-ARTICULATED RAILWAY POWER TRUCK

TECHNICAL FIELD

This invention relates to railway trucks especially power trucks for railway locomotives and the like. More particularly the invention relates to high adhesion efficiency semi-articulated four axle power trucks for railway locomotives.

BACKGROUND

The design of trucks for railway locomotives involves consideration of many factors such as load carrying capacity, dynamic stability, rail loading and weight distribution, tractive power capacity, adhesion efficiency and friction and wear of wheels and rails. For larger locomotives, trucks having multiple powered axles are generally required to provide the desired load supporting and tractive effort capabilities. Numerous forms of such trucks have been used or proposed including two, three and four axle arrangements having axles connected with a single frame as well as multiple frame truck units connected by a span member, each arrangement providing its own particular set of operating characteristics.

SUMMARY OF THE INVENTION

The present invention provides an eight wheel four axle semi-articulated railway locomotive power truck having significant advantages over many forms of two, three and four axle locomotive trucks. Obviously the four axle design provides the capability for carrying heavier loads and higher power developing potential than trucks with a lesser number of axles. Additionally, the provision of dual two axle sub-truck frames connected by a span bolster and semi-articulated for steering control provides high curving efficiency and reduced angle of attack with wear characteristics superior to conventional two, three and four axle trucks. Adhesion performance in curves is substantially improved by the reduction in angle of attack provided by the steering function of the semi-articulated feature.

The delivery of tractive effort from the sub-truck frames through a low mounted traction rod linkage provides superior adhesion efficiency which is maximized by other features of the truck design that promote equalization and minimize the effect of weight shift under power. Such features include centered support of the bolster between the axles of each sub-truck frame and the retention of freedom for vertical and longitudinal motion between the semi-articulated truck frame ends while maintaining the desired lateral interconnection for steering control. These features essentially maintain adhesion efficiency as an explicit function of the locomotive geometry substantially independent of primary and secondary suspension effects and allow suspension design to be directed to ride and equalization qualities.

These and other features and advantages of the invention will be more fully understood from the following description of certain preferred embodiments taken together with the accompanying drawings.

BRIEF DRAWING DESCRIPTION

In the drawings

DETAILED DESCRIPTION

Figure 1:
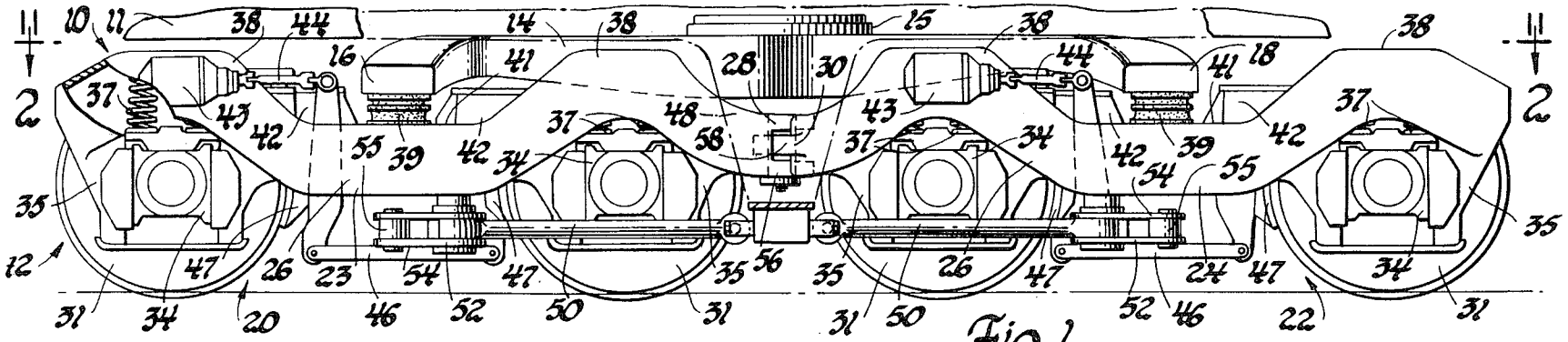
FIG. 1 is a fragmentary side view of a railway locomotive having a semi-articulated four axle railway power truck in accordance with the invention.
Figure 2:
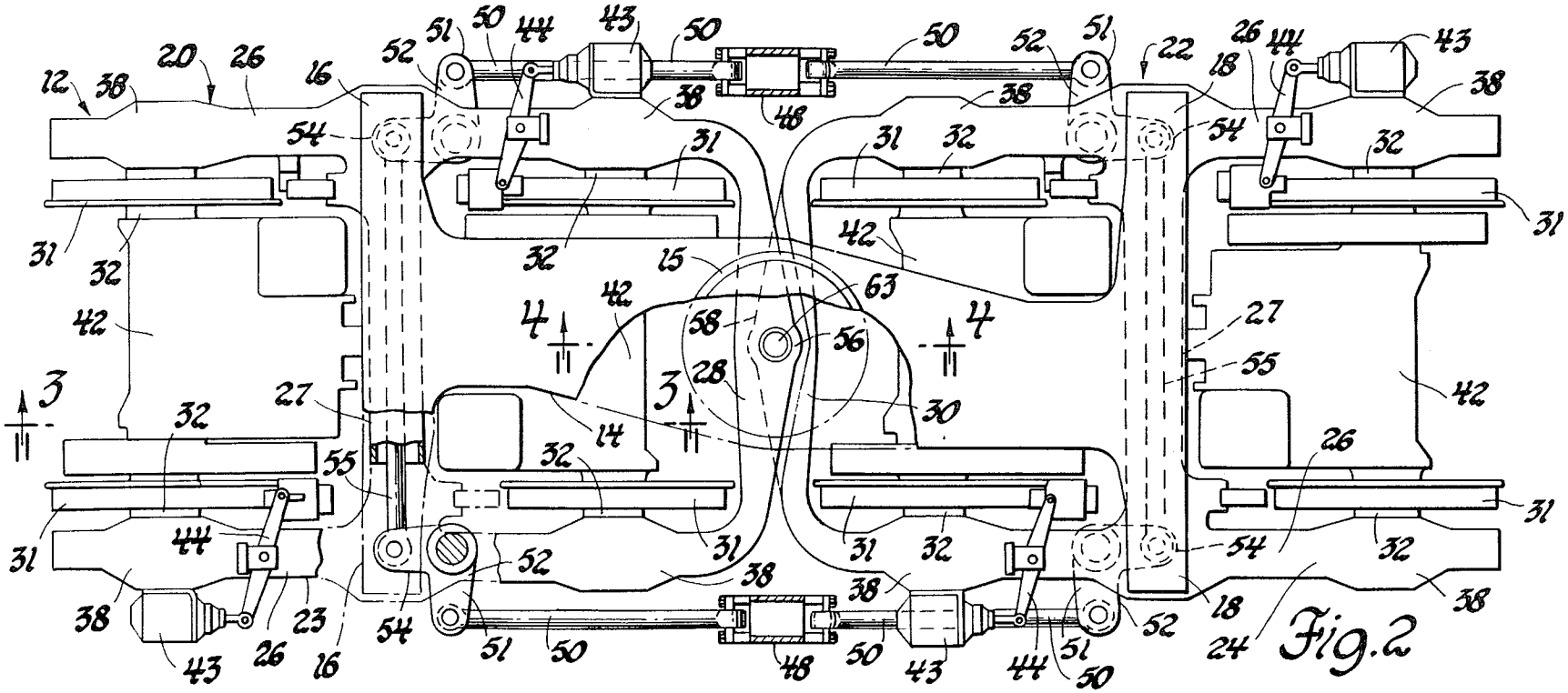
FIG. 2 is a plan view of the railway truck as seen from the plane indicated by the line 2—2 of FIG. 1.
Figure 3:
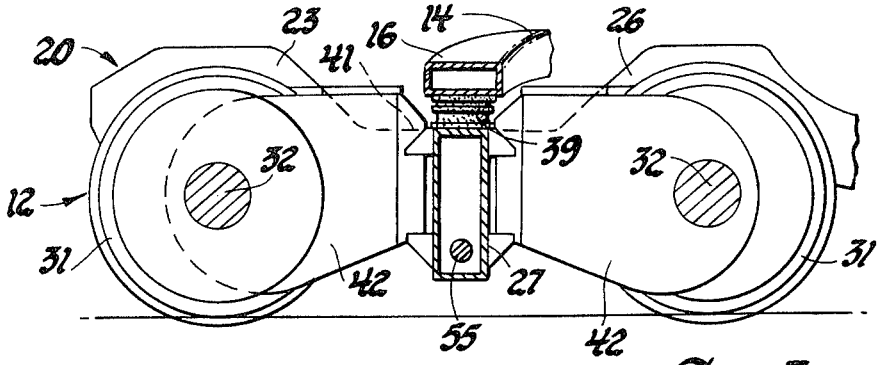
FIG. 3 is a fragmentary longitudinal cross-sectional view showing features of the truck frame and traction motor mountings from the plane indicated by the line 3—3 of FIG. 2.
Figure 4:
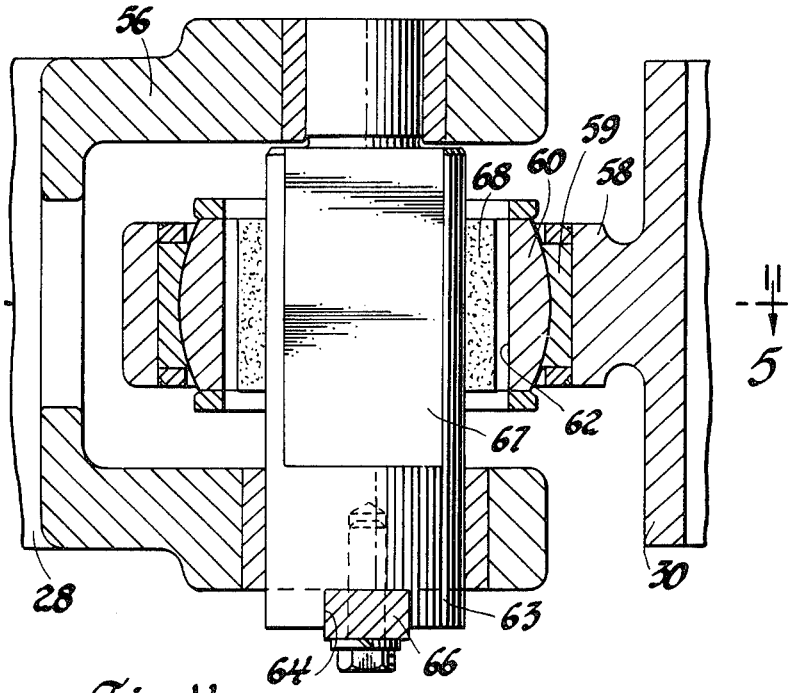
FIG. 4 is an enlarged longitudinal cross-sectional view showing the semi-articulated joint between the sub-truck frames from the plane indicated by the line 4—4 of FIG. 2.
Figure 5:
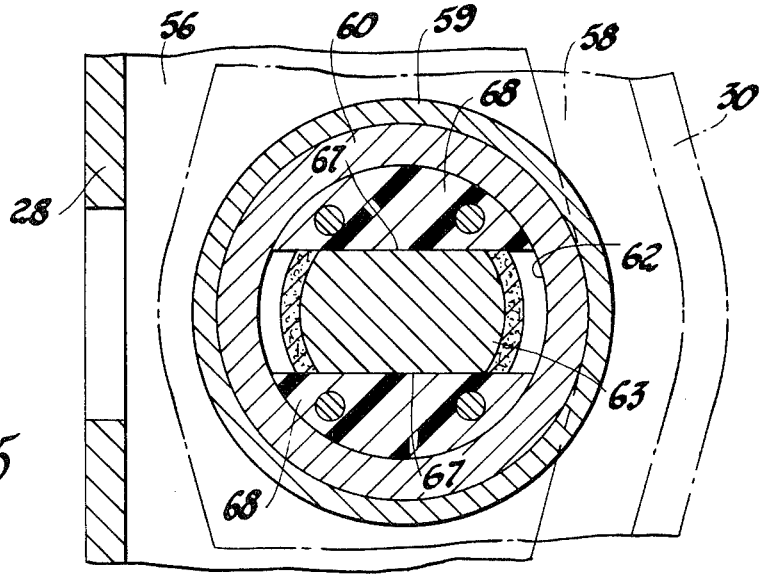
FIG. 5 is a horizontal cross-sectional view through the joint from the plane indicated by the line 5—5 of FIG. 4.

Referring first to FIG. 1 of the drawings, numeral 10 generally indicates a portion of one end of a railway locomotive having a carbody 11 supported by a four axle semi-articulated railway truck shown in FIGS. 1 through 5 and generally indicated by numeral 12.

Railway truck 12 includes a span bolster 14 that is pivotably connected at its center to the carbody by a center plate 15. From the center plate the bolster extends longitudinally forward and rearward approximately one quarter the total length of the truck to transversely extending support legs 16, 18.

The bolster is supported in a manner to be subsequently described by first and second interconnected sub-trucks 20, 22 having separate frames 23, 24 respectively. Each of the frames comprises a pair of drop center side rails 26 connected together by laterally extending center transoms 27. The side frames are also connected across the adjacent ends of the associated trucks by end transoms 28, 30 respectively which are interconnected in a manner to be subsequently described.

Each of the sub-trucks also includes two pairs of rail engaging wheels 31, supporting a pair of rotatable axles 32 carrying on their ends journal bearing boxes 34 retained in pedestals 35 of the sub-truck frames. Primary suspension means, such as coil springs 37, are provided between the journal boxes 34 and raised portions 38 near the ends of the sub-truck frames for supporting the frames on the wheel and axle assemblies. Secondary suspension means, in the form of resilient pads 39 or other suitable devices, are sandwiched vertically between the ends of the bolster support legs 16, 18 and dropped center portions 41 of the sub-truck frames the suspension pads being longitudinally centered between the axles and equidistant from the bolster center plate.

The primary suspension means permit vertical motion of the individual axle ends relative to the sub-truck frames within their respective pedestals 35 while maintaining substantial equalization of wheel loads. The secondary resilient pad suspensions not only carry vertical loads between the bolster and the sub-truck frames with resilient cushioning thereof but also permit limited pivoting and lateral motion of the sub-truck frames with respect to the bolster as will be subsequently more fully described. Placement of the secondary suspension devices equidistant from the bolster center plate and centered between their respective truck axles provides substantial equalization of vertical loads on the truck axles.

Each of the sub-trucks also includes a pair of traction motors 42, each geared to drive one of the axles 32 and supported between its respective axle and the adjacent center transom 27 of the respective sub-truck frame. Brake rigging is provided in the form of frame carried brake cylinders 43 acting through brake levers 44 and links 46 to actuate wheel engaging brake shoes 47 in conventional fashion.

In accordance with the invention, the tractive forces and the dynamic and mechanical braking forces are transmitted from the wheel and axle assemblies to the sub-truck frames through the axle mounted journal boxes 34 and the associated truck frame pedestals 35. These forces are then transmitted from each of the sub-truck frames to the locomotive carbody by mens of a low level horizontal traction rod linkage system connected with a pair of stanchions 48 that extend downwardly from opposite sides of the locomotive carbody to locations laterally opposite the longitudinal center of the truck and the associated center plate 15. If desired, the stanchions may, alternatively, be formed as extensions of the bolster 14 with the tractive and braking forces being transmitted to the carbody through the center plate 15.

Separate linkages for each sub-truck include longitudinal traction rods 50 that extend horizontally along the sides of the truck toward the front and rear from the bottoms of the stanchions 48, at a level preferably as low as possible and generally about ten inches above the rail, to connections with laterally projecting arms 51 of transfer levers 52 that are pivotally connected to the side rails of the respective sub-truck frames near the longitudinal centers thereof. Levers 52 also include generally longitudinal arms 54, thereby forming two bell crank mechanisms that are interconnected by a lateral transfer link 55 which extends through the transverse center transom 27 of its respective sub-truck to interconnect the longitudinal portions of the traction linkage extending along the truck sides.

The traction linkage not only provides for the transfer of traction and braking loads between the sub-truck frames and the locomotive carbody through the stanchions but also allows for relative turning and rocking motions of the individual sub-truck frames with respect to the associated ends of the bolster which they support. Such turning and rocking motions, generally about the centers of the sub-truck frames, as well as limited lateral motion with respect to the bolster are permitted by the resilient secondary suspension devices 39 located between the bolster legs and the sub-truck frames.

Further in accordance with the invention, the adjacent ends of the sub-truck frames are interconnected in semi-articulated fashion to provide interlocking control of the sub-truck frame turning motions while permitting freedom of the adjacent end portions of the sub-truck frames for relative vertical and longitudinal motion. This is accomplished in the embodiment of FIGS. 1 through 5 by providing, centrally of the end transoms 28 and 30, female and male connecting tongues 56, 58 respectively connected together by means of a pin and spherical bearing assembly.

The latter assembly comprises a spherical bearing member 59 received within the male tongue 58 and retaining for swivel motions therein a spherical bearing ball or journal 60. Journal 60 includes a vertically extending cylindrical opening 62 through which there extends a pin 63 extending between and supported in opposite arms of the female connecting tonque 56. A channel 64 across the bottom of the pin 63 receives a support strap 66 secured to the tongue 56 to maintain the pin in position and prevent its rotation within its supporting tongue 56. The lateral sides of the pin 63 are provided with flats 67 that are engaged by bearing shoes 68 fitted within the opening 62 on either side of the pin.

It should be noted that when the pin and tongues are centered, there is substantial longitudinal clearance between the pin and the periphery of the opening 62 of the spherical bearing. Also there is substantial vertical clearance between the single arm of the male tongue 58 and the adjacent inner sides of the dual arms of the female tongue 56. On the other hand, there is substantially no clearance laterally between the pin flats 67 and the associated bearing shoes 68 which engage the periphery of the opening 62.

The pin and tongue spherical bearing connection just described provides a construction referred to herein as semi-articulated, which positively interconnects the two sub-truck frames to require concurrent lateral motion of their ends. Thus they are interconnected for steering, or relative inter-relation of their turning motions to be constrained to equal amounts in opposite directions of rotation or oscillation. This provides a balancing of creep forces acting on the two sub-trucks during turning, thus giving a steering function between the sub-trucks that reduces wheel flange loads during turning by causing the axles to take a more normal or radial position with respect to the curving rails during a turn than would be the case if the sub-trucks were not laterally interconnected at their ends. At the same time, the clearance provided in the longitudinal and vertical directions for relative motion between the interconnected end transoms of the sub-trucks permits them to freely move with respect to one another in the longitudinal and vertical directions so as to avoid interfering with the weight transfer and load equalization characteristics otherwise provided by the truck assembly.

In this regard the design of the truck is such as to provide substantially equal distribution of the locomotive weight through the bolster to the separate sub-trucks combined with equal distribution of the weight on each sub-truck to the axles spaced equidistant from the secondary suspension elements supporting the bolster. This, combined with the low traction linkage system which efficiently transfer traction forces from the rail to the carbody, provides a very low amount of weight transfer of traction or braking forces from one axle to another. Thus there is provided a very high degree of adhesion efficiency for the truck. The overall result of the low weight transfer characteristics of the truck and the steering interconnection of the sub-trucks in a manner that does not adversely affect these good weight transfer characteristics is such as to provide a truck assembly having substantially greater traction efficiency than prior four, three or even two axle trucks during curve negotiation as well as during operation on tangent or straight track. Curving efficiency is improved and wheel and rail wear are reduced by the steering interconnection of the sub-trucks. Additionally, the low level traction rod system limits sub-truck pitching (fore-aft rocking) and corresponding carbody longitudinal oscillations.

Figure 6:
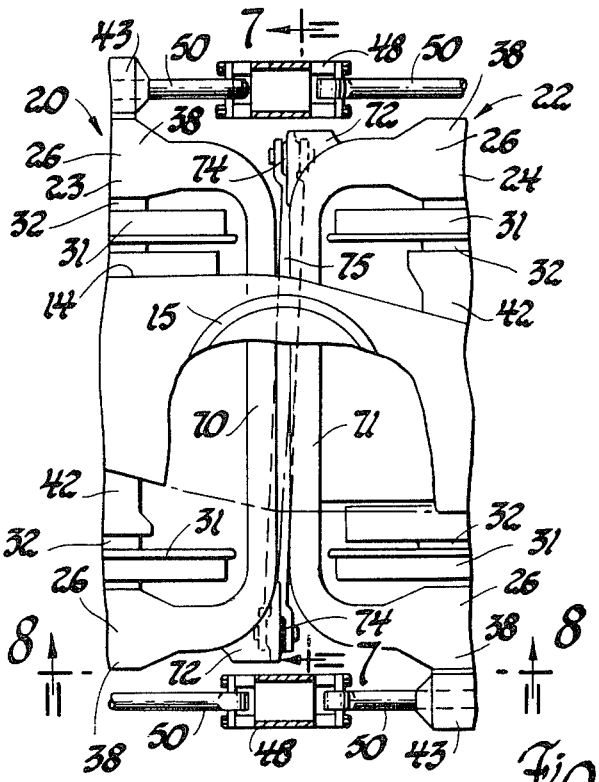
FIG. 6 is a fragmentary plan view of the central portion of another embodiment of railway power truck having an alternative form of semi-articulation of the sub-truck frames.
Figure 7:
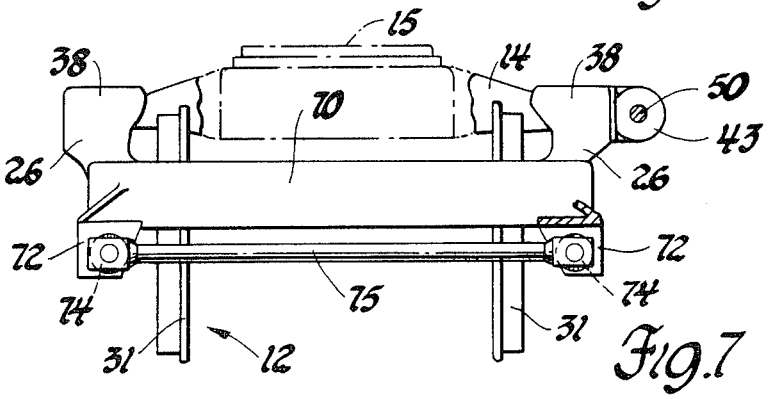
FIG. 7 is a transverse cross-sectional view of the articulating link arrangement from the plane indicated by the line 7—7 of FIG. 6.
Figure 8:
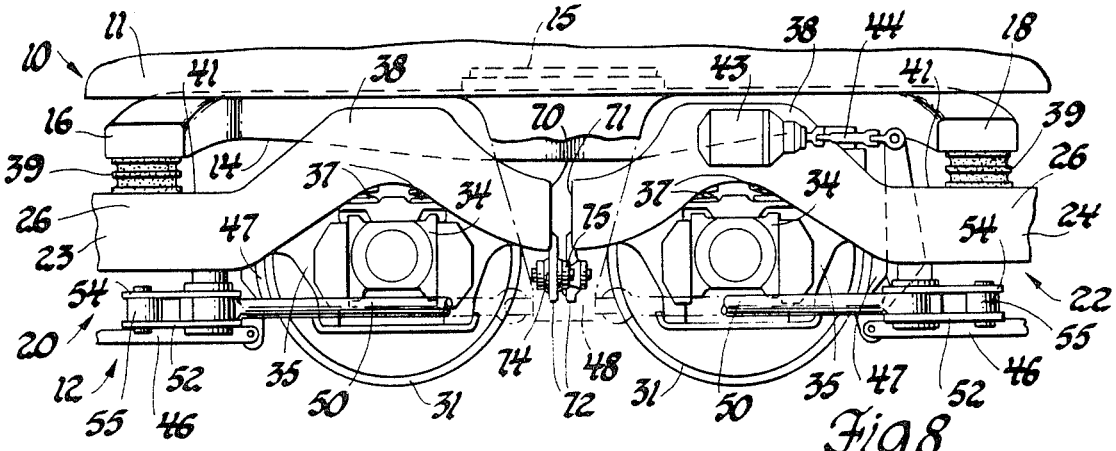
FIG. 8 is a fragmentary side view of the alternative embodiment showing the articulated link arrangement from the plane indicated by the line 8—8 of FIG. 6.

Referring now to FIGS. 6–8 of the drawings, there is shown an alternative embodiment of railway truck wherein the construction is generally similar to that first described but wherein the lateral interconnection of the sub-truck frames is accomplished in a different manner. For ease of understanding, like numerals are utilized for components like those of the first described embodiment.

The embodiment of FIGS. 6–8 differs only in respect to the end transoms 70, 71 of the sub-truck frames 23, 24. Here each transom is fitted with a cast on boss 72 into which a spherical bearing 74 is pressed. When the truck and transoms are placed adjacent one another as shown in the figures, the bosses 72 are located at diagonally opposite locations of the truck frames. The bosses are then connected laterally by a tie rod 75 which is pinned to the spherical bearing 74 in any suitable fashion that permits relative pivotal motion of the tie rod ends with respect to its connected bosses.

Like the previous arrangement, the tie rod system shown in FIGS. 6–8 positively interconnects the two sub-trucks of the truck assembly for concurrent lateral motion of their adjacent ends, thus requiring opposite turning motion of the two sub-trucks during curving. At the same time, complete freedom for relative vertical and longitudinal motion is provided to avoid destroying the balanced weight transfer characteristics of the truck suspension and traction rod systems which are like those of the previously described embodiment.

As may be seen, the functional characteristics with respect to steering and weight transfer of the two truck embodiments described previously are substantially the same. The embodiment of FIGS. 6–8 does however have the advantage that the two sub-truck frames of each truck are formed from identical castings and therefore could be interchanged if desired, whereas the construction of FIGS. 1–5 requires male and female connecting tongues on the end transoms of the two trucks making up the assembly. However, the latter construction can be manufactured at relatively little additional expense by the use of substitute cores for the male and female tongue portions of the end transoms. Further, the first described embodiment of FIGS. 1–5 has the advantage that the pinned connection between the end transoms will limit vertical and longitudinal motion to predetermined amounts, thereby maintaining tracking of the two connected sub-trucks under substantially all conditions which might arise during operation of the locomotive.

While the invention has been described by reference to certain preferred embodiments chosen for purposes of illustration, it should be understood that numerous changes could be made within the spirit and scope of the inventive concepts disclosed. Accordingly it is intended that the invention not be limited to the described embodiments but that it have the full scope permitted by the language of the following claims.

The embodiments of the invention in which an exclusive property or privilege is claimed are defined as follows.

1. In combination in a powered railway truck, a pair of multiple axle sub-trucks having frames individually supporting and pivotable with respect to a span bolster adapted to support a rail vehicle carbody, said sub-trucks being longitudinally disposed in tandem adjacent end to end relation, said bolster and carbody together constituting supported means carried by said sub-trucks, power means for driving the wheels of the truck, tractive force transfer means operatively longitudinally connecting the sub-truck frames with said supported means, and articulating means laterally positively connecting the adjacent ends of the two sub-truck frames to correlate pivotal turning movements of the sub-trucks relative to the bolster, said articulating means being operative to require substantially equal and opposite simultaneous turning movements of the sub-trucks but providing at least limited freedom of relative vertical and longitudinal movement of the adjacent ends of the sub-trucks with respect to one another, whereby coordinated turning control with isolation of inter-frame rocking and traction force effects is provided.

2. In combination in a powered railway truck, a pair of two axle, four wheel sub-trucks having frames individually supporting and pivotable with respect to a span bolster adapted to support a rail vehicle carbody, said sub-trucks being longitudinally disposed in tandem adjacent end to end relation, power means for driving the wheels of the truck, tractive force transfer means operatively longitudinally connecting the sub-truck frames with the vehicle carbody, and articulating means laterally positively connecting the adjacent ends of the two sub-truck frames to correlate pivotal turning movements of the sub-trucks relative to the bolster, said articulating means being operative to require substantially equal and opposite simultaneous turning movements of the sub-trucks but providing at least limited freedom of relative vertical and longitudinal movement of the adjacent ends of the sub-trucks with respect to one another, whereby coordinated turning control with isolation of inter-frame rocking and transfer force effects is provided.

3. The combination of claim 2 wherein said articulating means comprises vertically interleaved tongues of the two sub-truck frames connected by a pivot pin acting through a spherical ball joint having vertical clearance between the tongues and longitudinal clearance between the pin and the ball joint.

4. The combination of claim 2 wherein said articulating means comprises a transverse link swivelly connected at opposite corners to the adjacent ends of the two sub-truck frames.

5. A high adhesion efficiency articulated four axle power truck for a railway vehicle, said truck comprising a pair of sub-trucks each having a frame rotatably journaling two parallel axles spaced longitudinally with each axle supported by a pair of laterally spaced rail-engaging flanged wheels, the wheels, axles and their spacing and the frames of the two sub-trucks being of substantially equal dimensions and said sub-trucks being longitudinally disposed in end to end tandem relation, a span bolster supported at opposite ends on said sub-trucks by resilient suspension means, said suspension means providing for effective transfer of loads between the bolster and sub-trucks substantially solely along transverse vertical planes centered between the axles of their respective trucks, said bolster having means for supporting an associated railway carbody for pivotal movement on said bolster about a central pivot axis spaced longitudinally equally between said transverse planes, said bolster and carbody together constituting supported means carried by said sub-trucks, means for driving the wheels of said sub-trucks, tractive force transfer means operatively connectable between said sub-truck frame and said supported means, said force transfer means being effectively connected to the sub-truck frames at relatively low points spaced vertically between the axles rotational axes and the rail-engaging lower edges of said associated wheels, and articulating means connecting adjacent ends of the two sub-truck frames to correlate turning movements of the sub-trucks, said articulating means requiring substantially equal and coincident lateral movements of said adjacent frame ends to provide substantially equal simultaneous turning movements of said sub-truck members in opposite rotational directions while providing at least limited freedom for relative vertical and longitudinal movement of said adjacent ends with respect to one another, whereby effective inter-sub-truck turning control is established to minimize wheel to rail friction forces during turning while maintaining substantial isolation of tipping and traction forces between the sub-trucks to minimize weight transfer shifting of vertical load forces between the sub-frames and axles of the truck.

6. The combination of claim 5 wherein said articulating means comprises vertically interleaved tongues of the two sub-truck frames connected by a pivot pin acting through a spherical ball joint having vertical clearance between the tongues and longitudinal clearance between the pin and the ball joint.

7. The combination of claim 5 wherein said articulating means comprises a transverse link swivelly connected at opposite corners to the adjacent ends of the two sub-truck frames.

* * * * *